US006703575B1

(12) United States Patent
Yamamoto

(10) Patent No.: US 6,703,575 B1
(45) Date of Patent: Mar. 9, 2004

(54) ARC-EXTINGUISHING SYSTEM FOR A CONTACT SWITCHING APPARATUS

(75) Inventor: Kyoichi Yamamoto, Nagoya (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 845 days.

(21) Appl. No.: 09/083,936

(22) Filed: May 26, 1998

(30) Foreign Application Priority Data

Dec. 26, 1997 (JP) ..... 9-360179
Feb. 26, 1998 (JP) ..... 10-045493

(51) Int. Cl.[7] ..... H01H 33/70
(52) U.S. Cl. ..... 218/46; 218/149; 218/155; 218/157
(58) Field of Search ..... 335/132, 202, 335/201; 218/46, 47, 51, 52, 76, 81, 149, 151, 155, 156, 157

(56) References Cited

U.S. PATENT DOCUMENTS

| | | | | |
|---|---|---|---|---|
| 3,773,992 A | * | 11/1973 | Mune | 218/156 |
| 4,489,225 A | * | 12/1984 | Masuda et al. | 218/155 |
| 4,596,909 A | * | 6/1986 | Kakizoe et al. | 218/156 |
| 4,616,203 A | | 10/1986 | Kakizoe et al. | |
| 4,652,707 A | | 3/1987 | Mori et al. | |
| 5,072,081 A | * | 12/1991 | Sepelak et al. | 218/155 |
| 5,097,104 A | | 3/1992 | Weichert | |
| 5,756,951 A | * | 5/1998 | Manthe et al. | 218/35 |
| 6,191,377 B1 | | 2/2001 | Roesner et al. | |

FOREIGN PATENT DOCUMENTS

| | | |
|---|---|---|
| DE | 8531354 U1 | 2/1986 |
| DE | 4018674 A1 | 4/1991 |
| JP | SHO 57-148722 U | 9/1982 |
| JP | SHO 58-14647 U | 1/1983 |
| JP | 01-241721 | 9/1989 |
| JP | 5-24099 | 6/1993 |
| JP | HEI 6-6425 U | 2/1994 |
| JP | HEI 6-9392 U | 3/1994 |
| JP | 07-272597 | 10/1995 |
| JP | 200-513495 | 10/2000 |

OTHER PUBLICATIONS

Erk, A.; Schmelzle, M.: „*Grundlagen der Schaltgerätetechnik*, Berlin (inter alia); Springer, 1974, pp. 261–274 (no month).

Telemecanique, Groupe Schneider, Panorama Serie F, Apr., 1996.

* cited by examiner

*Primary Examiner*—Lincoln Donovan
(74) *Attorney, Agent, or Firm*—Sughrue Mion, PLLC

(57) ABSTRACT

An arc-extinguishing system for a contact switching apparatus having a plurality pieces of grid plate for arc extinction arranged outside the contact switching apparatus so as to be substantially vertical to a movable contact, and an arc box as well as an arc cover for covering the contact switching apparatus as well as arc-extinguishing grid plates, in which a thin-plate rib extending in a direction of an array of the arc-extinguishing grid plates is provided on the arc cover made of resin having elasticity, and the arc-extinguishing grid plates are fixed to the thin-plate rib by being pressed against end surfaces of the arc-extinguishing grid plates through connecting of the arc box to the arc cover.

5 Claims, 12 Drawing Sheets

ARC-EXTINGUISHING SYSTEM FOR A CONTACT SWITCHING APPARATUS

FILED OF THE INVENTION

The present invention relates to an arc-extinguishing system for a contact switching apparatus.

BACKGROUND OF THE INVENTION

FIG. 12 and FIG. 13 show an arc-extinguishing system for a contact switching apparatus based on the conventional technology. The contact switching apparatus comprises a movable contact 2 comprising an electrically conductive bar with contact points 1 at both ends thereof, fixed contacts 4 with contact points 3 provided opposite to the contact points 1 of the movable contact 2, a cross bar 5 for supporting the movable contact 2 and switching the contact points by conveying movement of an electromagnet device to the movable contact 2, and an arc box 6 made from heatproof resin for covering a contact switching mechanism section comprising the movable contact 2, fixed contacts 4 and the cross bar 5 to insulate electro-conducting sections of electrodes from each other.

The contact switching apparatus further comprises a plurality pieces of arc-extinguishing grid plate 7 inserted into a plurality of longitudinal concave grooves 6*a* formed on the internal surface of the arc box 6 and being vertical to the movable contact 2, an arc cover 10 fixed to the top surface of the arc box 6 by screws 8 and constituting a gas blow-off opening section 9 opening to an external wall section with the arc box 6, heatproof spacer pieces 11 between the arc box 6 and teeth 10*a* of the arc cover 10 for fixing the arc-extinguishing grid plates 7, and arc runners 12.

The arc-extinguishing system for a contact switching apparatus having the configuration described above cuts off a current between the contact points by driving arc generated between the contact points 1 and 3 of the movable contact 2 and the fixed contact 4 by means the arc-extinguishing grid plates 7 when the cross bar 5 is returned and separating the arc so as to be led into spaces between the arc-extinguishing grid plates 7 provided in parallel. In the above processes, gas generated when the arc sublimates peripheral parts with its thermal energy passes through the spaces between the arc-extinguishing grid plates 7 to the space above the arc-extinguishing grid plates 7, and further proceeds along the arc cover 10, and then is discharged from the gas blow-off opening section 9 to the outside.

The gas having passed through the spaces between the arc-extinguishing grid plates 7 is cooled down by hitting the arc cover 10 with a radiating surface widely provided on the outside thereof and going on through a space comparatively far from the place where the arc is generated, and the temperatures in the gas is left, ideally, to decrease as far as a temperature which does not give any damage to the outside, and then the gas is discharged.

Also, when the cross bar 5 closes or opens a contact according to the suction force of an electro-magnet, severe shock vibrates the arc-extinguishing grid plates 7. For this reason, the arc-extinguishing grid plates 7 inserted in the longitudinal concave grooves 6*a* are fixed through the spacer pieces 11 to prevent occurrence of rattling other than a switching sound as well as abrasion due to the vibration. The arc cover 10 covers the upper section of the arc box 6 so as to apply pressure to the arc-extinguishing grid plates 7 and is secured by the screws 8 near the arc-extinguishing grid plates 7.

When opening and closing the contact point, the cross bar 5 slides along a sleeve-shaped guide member 13 attached to the arc box 6 so as to avoid contact with the arc box 6 which is easily worn out.

In the conventional type of arc-extinguishing system for a contact switching apparatus, the arc box 6 and the arc cover 10 are formed with heatproof and thermosetting resin, so that the arc-extinguishing grid plates 7 are not melted even at an elevated temperature due to heat of arc, and on the other hand, those components have no elasticity, so that any method of fixing the arc-extinguishing grid plates 7 such as press fitting can not be employed to prevent rattling thereof.

For this reason, the arc-extinguishing grid plates 7 can not be fixed unless there are spacer pieces 11 having elasticity among the plates, or unless the arc-extinguishing grid plates 7 are bent or crimped, so that the shape of the arc-extinguishing grid plates 7 has to be complicated, which may cost quite a lot for assembly thereof.

Also, foreign matters such as chips of wires produced during works easily enter from the gas blow-off opening section 9, and if some of the matters have a size less than a space between the arc-extinguishing grid plates 7, the fine matters can enter into sections where the movable contact 2 and fixed contact 4 are provided, which causes burning of an electro-magnet due to imperfect contact or imperfect charge to be generated.

In the conventional type of arc-extinguishing system for a contact switching apparatus, gas generated by arc passes through the spaces between the arc-extinguishing grid plates 7, and is discharged from the gas blow-off opening section 9 as it is, so that gas with high temperature is discharged unless the arc-extinguishing grid plates 7 are made as large as a distance so as to enable sufficient cooling down of the gas.

To solve the problems as described above, the arc box 6 and the arc cover 10 are formed with heatproof and thermosetting resin in the conventional type of arc-extinguishing system, so that fine projections or the like can not be made in a narrow space due to the flowing characteristic as well as strength of resin at the time of molding, and for this reason the arc-extinguishing system becomes disadvantageously larger in accordance with the size of the arc-extinguishing grid plates 7.

Also, in the conventional type of arc-extinguishing system for a contact switching apparatus, discharged gas is diffused from the gas blow-off opening section 9, which causes insulation outside the adjacent arc-extinguishing systems to be reduced. Shorting between phases easily occurs in this section at the time of abnormality such that arc is not completely cut off, and grounding may occur when a distance from the arc extinguishing system to a control board is short.

In the conventional type of arc-extinguishing system for a contact switching apparatus, name plates for conveying various information are attached to a surface of the arc cover 10 as a front surface of the electromagnetic contactor, but heat is also conveyed to the arc cover 10 with heated gas, so that, when an ordinary paper name plate is used, it is easily peeled off. And for this reason, information is directly printed onto the arc cover 10 in many cases. However, printing onto the surface of a molded component made of resin is quite difficult and printed color is easily changed due to heat.

Also, in the conventional type of arc-extinguishing system for a contact switching apparatus, there are many cases where the cross bar 5 is constructed by heatproof resin and is reinforced with grass fibers like in cases of the arc box 6 and the arc cover 10. And for this reason, the cross bar 5 is poor in the sliding capability which promotes its abrasion, so that the guide member 13 has to be added to the bar.

SUMMARY OF THE INVENTION

It is an object of the present invention to obtain an arc-extinguishing system in which arc-extinguishing grid plates having a simple form which can be built with low cost by properly fixing the arc-extinguishing grid plates without using any spacer or the like, to obtain an arc-extinguishing system in which intrusion of foreign matters to the inside of the system is prevented, to obtain a compact type of arc-extinguishing system with a path in which a gas is easily cooled down before the gas is discharged to the outside for the purpose to make the arc-extinguishing grid plates smaller, to obtain an arc-extinguishing system in which diffusion of gas can be prevented without using any external shield, to obtain an arc-extinguishing system in which name plates can freely be selected by suppressing conduction of heat to an arc cover, and to obtain a low-cost arc-extinguishing system not requiring any additional component such as a guide member.

With the arc-extinguishing system for a contact switching apparatus according to the present invention, by pressing a thin-plate rib formed on an arc cover made of resin having elasticity against end surfaces of arc-extinguishing grid plates, the arc-extinguishing grid plates are fixed to the thin-plate rib, and for this reason there is provided the effects that trouble of mounting any spacer as an additional component on the plates can be saved, the way of assembly can be simpler, the number of components can be reduced, cost can be decreased, movement of arc-extinguishing grid plates can accurately be restricted, and generation of rattling due to vibrations of shocks and abrasion of sections where the arc-extinguishing grid plates are fixed can be prevented.

With the arc-extinguishing system for a contact switching apparatus according to the present invention, a plurality of projections vertically formed from the arc cover are inserted into spaces between arc-extinguishing provided in parallel to each other, so that movement of the arc-extinguishing grid plates can be restricted, and an area which allows foreign matters intruding from a gas blow-off opening section to pass through can be restricted by embedding the projections in the gaps between the arc-extinguishing grid plates, and for this reason there is provided the effect that intrusion of foreign matters can be prevented.

With the arc-extinguishing system for a contact switching apparatus according to the present invention, the projections are provided in a staggered form from the arc cover, and a void between the arc cover and a top surface of the arc-extinguishing grid plates is partitioned into spaces in a staggered arrangement, so that gas generated due to arc is prevented from direct discharging, and the gas can be sufficiently cooled down by extending a path for outflow of the gas, and for this reason there is provided the effect that the arc-extinguishing system can be minimized as a whole.

With the arc-extinguishing system for a contact switching apparatus according to the present invention, an internal surface of the thin-plate rib for fixing the arc-extinguishing grid plates is a corrugated surface, so that, when gas generated due to arc is going along the corrugated surface, eddy is generated, and the gas can sufficiently be cooled down by delaying a time until the gas is discharged, and for this reason there is provided the effect that the arc-extinguishing system can be minimized as a whole.

With the arc-extinguishing system for a contact switching apparatus according to the present invention, in the arc-extinguishing system for a contact switching apparatus having a plurality pieces of grid plate for arc extinction arranged outside the contact switching apparatus so as to be substantially vertical to a movable contact, and an arc box as well as an arc cover for covering the contact switching apparatus as well as arc-extinguishing grid plates, a bottom face of the arc cover opposite to the end surface of the arc-extinguishing grid plates is a corrugated surface, so that, when gas generated due to arc is going along the corrugated surface, eddy is generated, and the gas can sufficiently be cooled down by delaying a time until the gas is discharged, and for this reason there is provided the effect that the arc-extinguishing system can be minimized as a whole. Also, the section to which the gas is directly applied is a peak section of the corrugated surface, so that damages are hardly received and a surface area is increased, which enables a form adapted to effective heat radiation.

With the arc-extinguishing system for a contact switching apparatus according to the present invention, a gas blow-off opening section is opened at an angle, which gives a direction to a flow of gas discharged from the gas blow-off opening section, so that bad influence due to gas over the outside can be prevented before it works.

With the arc-extinguishing system for a contact switching apparatus according to the present invention, each of the gas blow-off opening sections is opened at an angle so that gas discharged from one of the gas blow-off opening sections and that discharged from the adjacent opening section are blown off in directions far off from each other, so that each gas after the discharge does not join to each other, and for this reason there is provided the effect that insulation is not reduced.

With the arc-extinguishing system for a contact switching apparatus according to the present invention, each of the gas blow-off opening sections is opened at an angle in a direction alternately upward and downward so that gas discharged from one of the gas blow-off opening sections and that discharged from the adjacent opening section are blown off in directions vertically far off from each other, so that each gas after the discharge does not join to each other, and for this reason there is provided the effect that insulation is not reduced.

With the arc-extinguishing system for a contact switching apparatus according to the present invention, a gas blow-off opening section having an L-shaped path is opened to the side face of the arc box, so that gas can be sufficiently cooled down by extending a path and delaying a time until the gas is discharged, and for this reason there is provided the effect that the arc-extinguishing system can be minimized as a whole.

With the arc-extinguishing system for a contact switching apparatus according to the present invention, an arc cover has a double cover structure by a void for heat insulation, so that heat is hardly conveyed to the external surface of the arc cover, and for this reason there is provided the effect that a name plate can freely selected on the external surface of the arc cover.

With the arc-extinguishing system for a contact switching apparatus according to the present invention, a cylindrical guide section for slidably supporting a cross bar for the contact switching apparatus is monolithically molded to the arc cover, and for this reason there is provided the effect that any additional component avoiding a combination of components having a bad sliding capability is not required, which allows the cost to be reduced.

With the arc-extinguishing system for a contact switching apparatus according to the present invention, a gas blow-off opening section is covered by the pectinated projections and for this reason there is provided the effect that intrusion of foreign matters bigger than a space between pectinated projections can be prevented.

Other objects and features of this invention will become understood from the following description with reference to the accompanying drawings.

DESCRIPTION OF THE PREFERRED EMBODIMENTS

Figure 1:
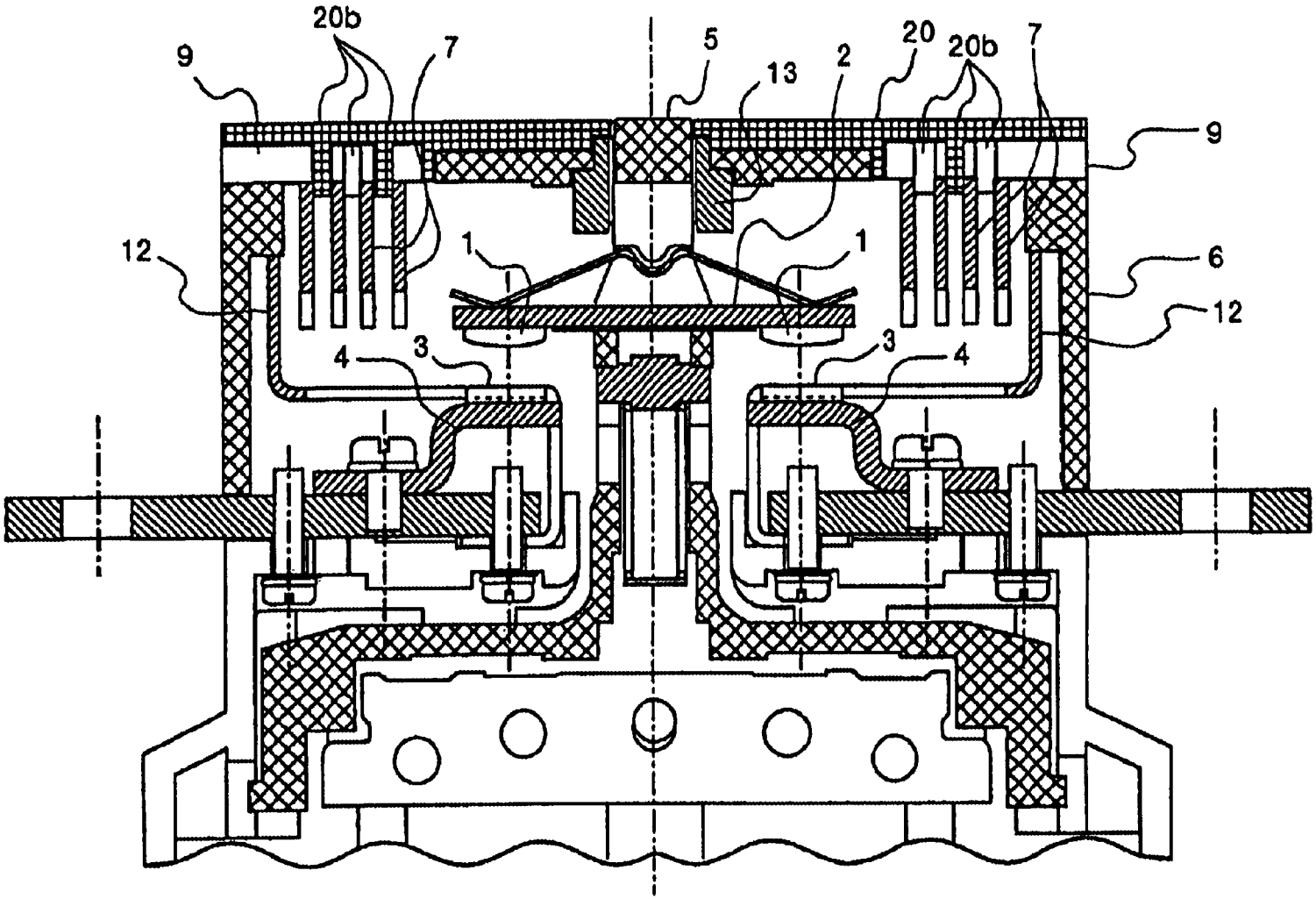
FIG. 1 is a sectional front view showing Embodiment 1 of an arc-extinguishing system for a contact switching apparatus according to the present invention.
Figure 2:
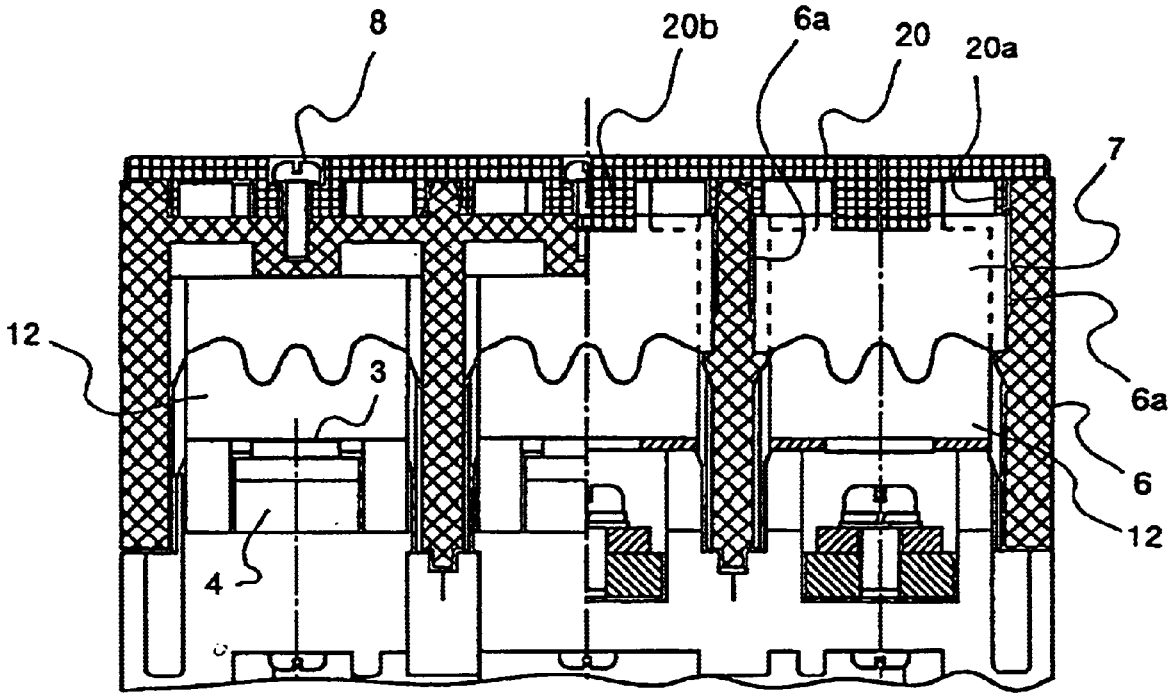
FIG. 2 is a sectional side view showing Embodiment 1 of the arc-extinguishing system for a contact switching apparatus.
Figure 3:
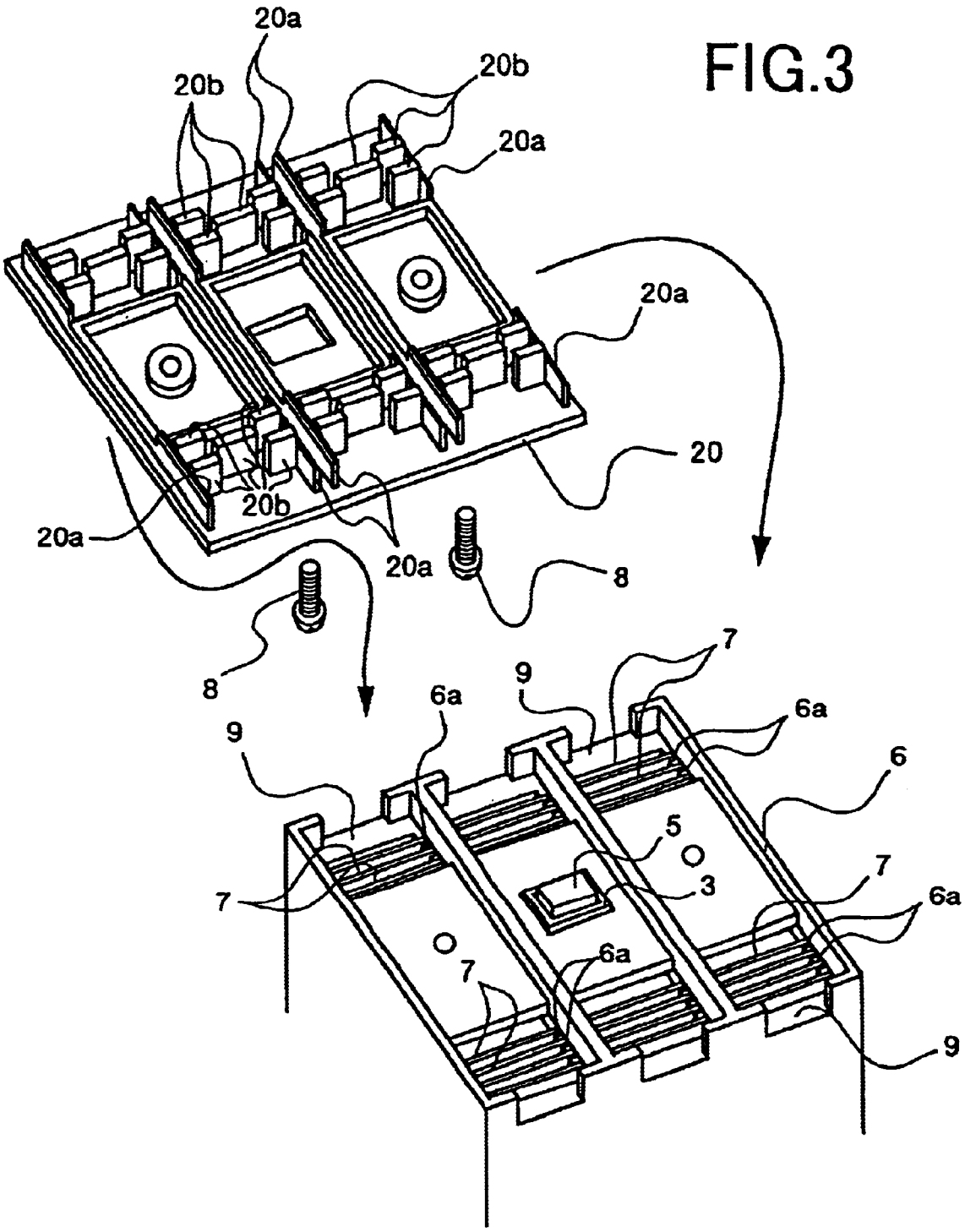
FIG. 3 is an exploded perspective view showing Embodiment 1 of the arc-extinguishing system for a contact switching apparatus.
Figure 4:
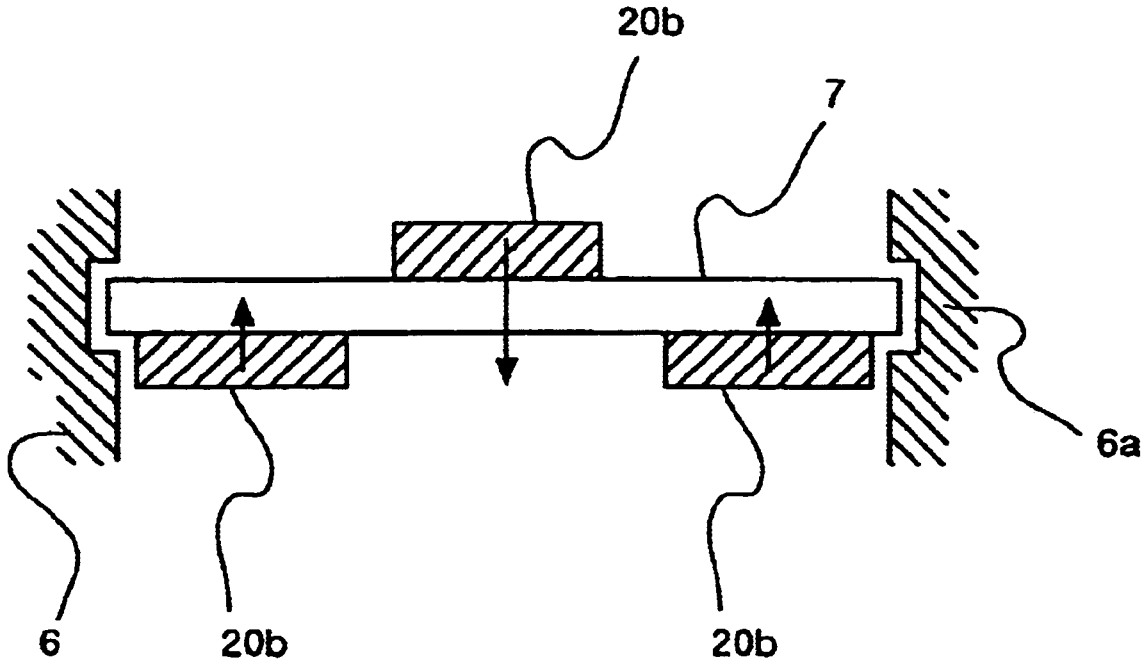
FIG. 4 is an explanatory view showing a structure for fixing an arc-extinguishing grid plate in Embodiment 1.

Detailed description is made hereinafter for preferred embodiments of an arc-extinguishing system for a contact switching apparatus according to the present invention with reference to the related drawings. It should be noted that the same reference numerals in the embodiments described below are assigned to the sections corresponding to those based on the conventional technology, so that description thereof is omitted herein.

FIG. 1 to FIG. 4 each show Embodiment 1 of the arc-extinguishing system for a contact switching apparatus according to the present invention respectively. An arc cover 20 is obtained by monolithically forming thin-plate ribs 20*a* entirely constructed with a molded component made from resin having elasticity such as thermoplastic resin, extending in the direction of an array of the arc-extinguishing grid plates 7 (a lateral direction in FIG. 1), crossing top end surfaces of the arc-extinguishing grid plates 7 and pressing the surfaces thereof, and projections 20*b* vertically projected in a staggered arrangement to be inserted among the arc-extinguishing grid plates 7 without any gap thereamong. The arc cover 20 is fixed, as is in the conventional type, onto the top surface of an arc box 6 with screws 8 and forms a gas blow-off opening section 9 with the arc box 6.

In the arc-extinguishing system for a contact switching apparatus described above, by connecting the arc cover 20 onto the top surface of the arc box 6 with the screws 8, the thin-plate ribs 20*a* for the arc cover 20 are directly pressed against the arc-extinguishing grid plates 7 inserted into longitudinal concave grooves 6*a* of the arc box 6 so as to be engaged in the arc-extinguishing grid plates 7 and the arc-extinguishing grid plates 7 are fixed. The arc cover 20 having also elasticity always applies pressure to the arc-extinguishing grid plates 7 thereby, which allows movement of the arc-extinguishing grid plates 7 to be suppressed.

Also, projections 20*b* for the arc cover 20 are inserted into spaces between the arc-extinguishing grid plates 7 in a staggered form, and press the arc-extinguishing grid plates 7, so that movement of the arc-extinguishing grid plates 7 can be suppressed due to friction. Also, the projections 20*b* effectively function as a shock absorber because the projections are inserted into spaces among the arc-extinguishing grid plates 7.

In the arc-extinguishing system for a contact switching apparatus as described above, gas generated due to arc passes through spaces between the arc-extinguishing grid plates 7 and is diffused to each space formed by the projections 20*b*. The space above the arc-extinguishing grid plates 7 is partitioned in a staggered form with the projections 20*b* to be formed to a labyrinth, so that the gas goes forward turning right and left.

As a result, the gas stays inside the arc-extinguishing system for a longer time as compared to a case where the gas goes straight. The gas is sufficiently cooled down during the time, and is discharged from the gas blow-off opening section 9 to the outside.

When foreign matters are intruded from the gas blow-off opening section 9, the matters are stopped by the projections 20*b*. The projections 20*b* are inserted into the arc-extinguishing grid plates 7 with no space therebetween, so that foreign matters incapable of passing through the projections can not intrude in the direction of the switching apparatus.

Fine foreign matters can pass through the sections, but can not go through the obstacle between the projections 20*b* and the arc-extinguishing grid plates 7 provided in a double level, so that the fine foreign matters try to go on along the projections 20*b* in a staggered form in the opposite direction to a flow of gas but they are eventually discharged from the gas blow-off opening section 9.

Figure 5:
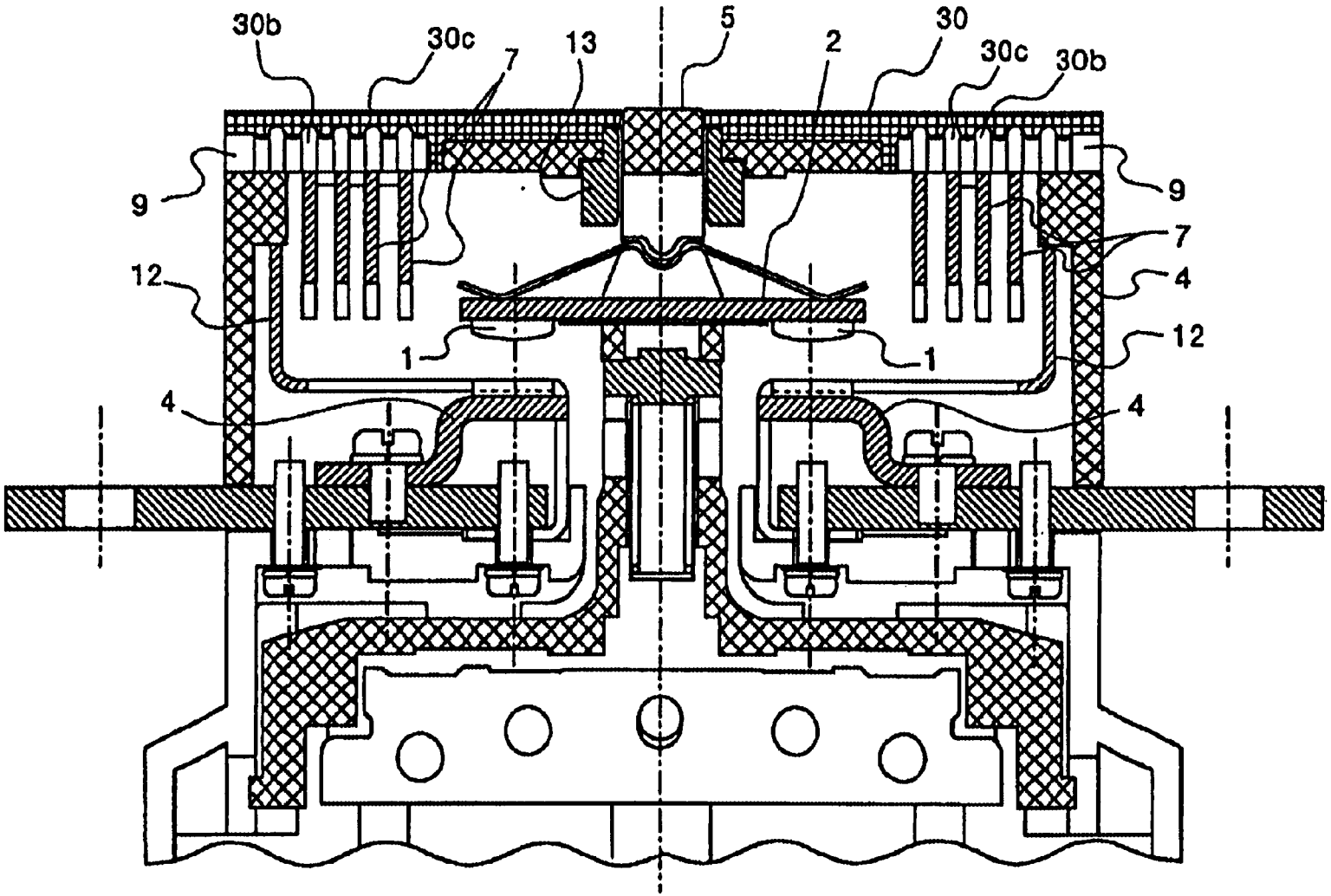
FIG. 5 is a sectional front view showing Embodiment 2 of an arc-extinguishing system for a contact switching apparatus according to the present invention.
Figure 6:
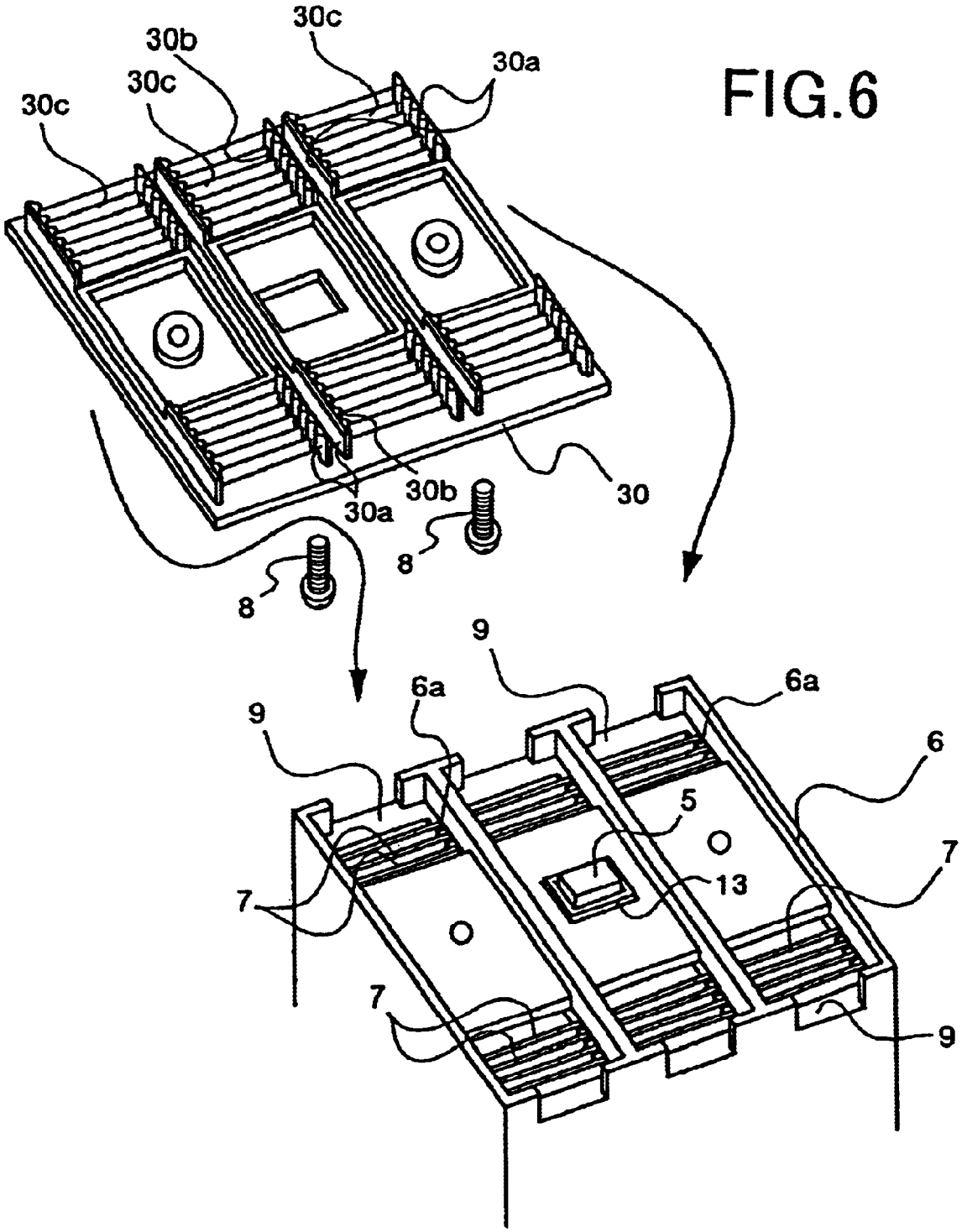
FIG. 6 is an exploded perspective view showing Embodiment 2 of the arc-extinguishing system for a contact switching apparatus.

FIG. 5 and FIG. 6 show Embodiment 2 of the arc-extinguishing system for a contact switching apparatus according to the present invention respectively. An arc cover 30 has thin-plate ribs 30*a* comprising a molded component entirely made of thermoplastic resin, extending in the direction of an array of the arc-extinguishing grid plates 7 (a lateral direction in FIG. 1), crossing top end surfaces of the arc-extinguishing grid plates 7, and pressing the surfaces thereof.

The internal surface of the thin-plate rib 30*a* is molded to a corrugated surface 30*b* corrugating in the direction of an array of the arc-extinguishing grid plates 7 (a lateral direction in FIG. 5), in other words, in the direction of a flow of gas, and a bottom face of the rib opposite to the top end surface of the arc-extinguishing grid plates 7 is molded to a corrugated surface 30*c* corrugating in the direction of an array of the arc-extinguishing grid plates 7 (in the lateral direction in FIG. 5), in other words, in the direction of a flow of gas.

Also in this embodiment, by connecting the arc cover 30 onto the top surface of the arc box 6 with the screws 8, the thin-plate ribs 30*a* for the arc cover 30 are directly pressed against the arc-extinguishing grid plates 7 inserted into longitudinal concave grooves 6*a* of the arc box 6 so as to be engaged in the arc-extinguishing grid plates 7 and the arc-extinguishing grid plates 7 are fixed. The arc cover 30 having also elasticity always applies pressure to the arc-extinguishing grid plates 7 thereby, which allows movement of the arc-extinguishing grid plates 7 to be suppressed.

Gas having passed through spaces between the arc-extinguishing grid plates 7 is first received by thick peak sections of the corrugated surface 30*c*, so that damages due to application of heated gas seldom occur. The gas generates eddies when going along the corrugated surfaces 30*b* and 30*c*. With the eddies, the entire space above the arc-extinguishing grid plates 7 other than the sections along the corrugated surfaces 30*b* and 30*c* is agitated, which does not allow the gas to go straight to the gas blow-off opening section 9.

As a result, the gas stays inside the arc-extinguishing system for a longer time as compared to a case where the gas goes straight. The gas is sufficiently cooled down during the time, and is discharged from the gas blow-off opening section 9 to the outside.

Figure 7:
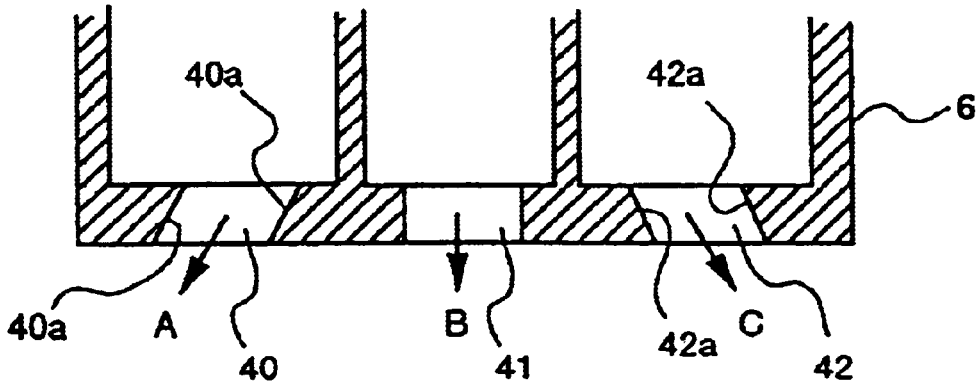
FIG. 7 is a sectional plan view showing a key section of Embodiment 3 of an arc-extinguishing system for a contact switching apparatus.

FIG. 7 shows Embodiment 3 of the arc-extinguishing system for a contact switching apparatus according to the present invention. In this embodiment, there is provided in a three-phase contact switching apparatus, in which, of gas blow-off opening sections 40, 41 and 42 discretely provided in each phase, side walls 40*a* and 42*a* of the gas blow-off opening sections 40 and 42 in two phases placed in the both sides thereof are inclined outward respectively.

Namely, the gas blow-off opening sections 40 and 42 are opened having inclination outward respectively so that gas discharged from one of the gas blow-off opening sections and that discharged from the adjacent gas blow-off opening section are blown off in directions far off from each other, which gives each direction to each flow of gas discharged from the gas blow-off opening sections 40 and 42 to the outside.

In this arc-extinguishing system, when gas generated inside thereof is discharged from the gas blow-off opening sections 40, 41 and 42 to the outside, the gas discharged from two phases of the gas blow-off opening sections 40 and 42 placed in the both sides flows along the direction of inclination which each of the side walls 40*a* and 42*a* has. With this feature, each gas discharged from each of the gas blow-off opening sections 40, 41 and 42 respectively flows in a direction far off from the others as indicated by the arrows A, B, and C.

With this feature, each gas from the adjacent phases does not join to each other outside the arc-extinguishing system, so that insulation is not interfered with shorting between the phases due to gas.

Figure 8:
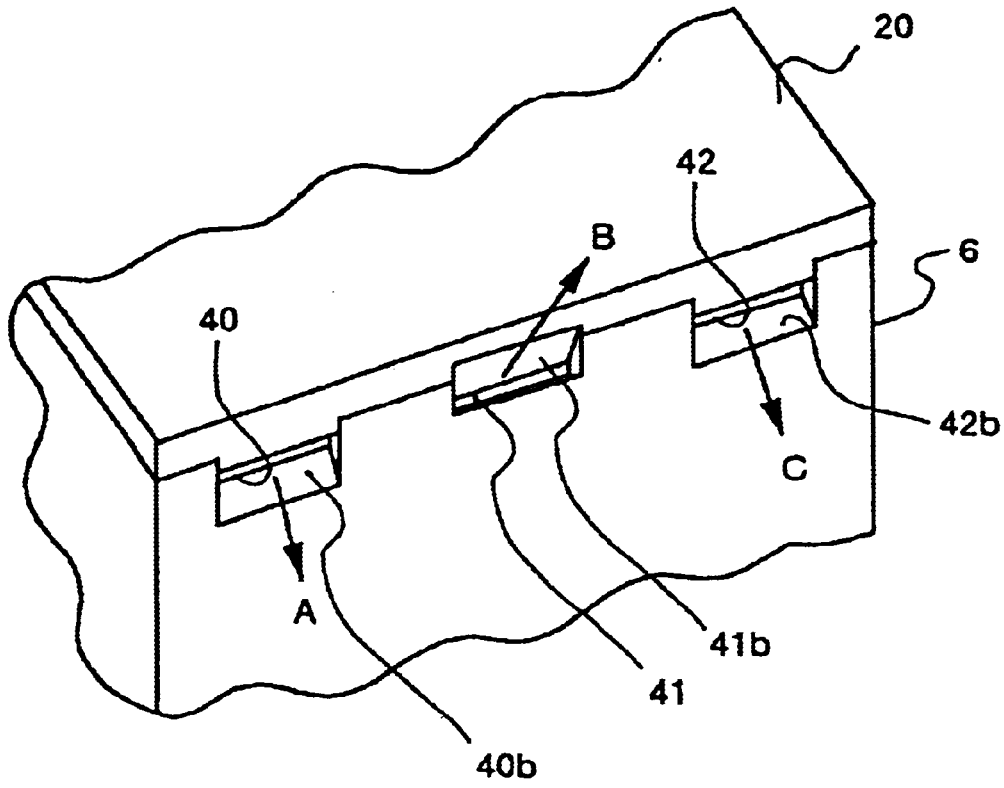
FIG. 8 is a perspective view showing a key section of Embodiment 4 of an arc-extinguishing system for a contact switching apparatus.

FIG. 8 shows Embodiment 4 of the arc-extinguishing system for a contact switching apparatus according to the present invention. In this embodiment, there is provided a three-phase contact switching apparatus, in which upper and lower faces 40*b* and 42*b* of the gas blow-off opening sections 40 and 42 placed in the both sides are inclined downward respectively and upper/lower faces 41*b* of the central gas blow-off opening section 41 is inclined upward. Namely, the gas blow-off opening sections 40, 41 and 42 are opened each at an angle in a direction alternately upward and downward so that gas discharged from one of the gas blow-off opening sections and that discharged from the adjacent opening section are blown off in directions vertically far off from each other.

In this arc-extinguishing system, when gas generated inside thereof is discharged from the gas blow-off opening sections 40, 41 and 42 to the outside, the gas discharged from two phases of the gas blow-off opening sections 40 and 42 placed in the both sides flows, as indicated by the arrows A and C, downward along the direction of inclination which both of the upper/lower faces 40*b* and 42*b* have, and the gas discharged from the central gas blow-off opening sections 41 flows, as indicated by the arrow B, upward along the direction of inclination which the upper/lower faces 41*b* has.

With this feature, each gas discharged from each of the gas blow-off opening sections 40, 41 and 42 respectively flows in a direction far off from the others as indicated by the arrows A, B, and C, so that each gas from the adjacent phases does not join to each other outside the arc-extinguishing system, and for this reason insulation is not interfered with shorting between the phases due to gas.

Figure 9:
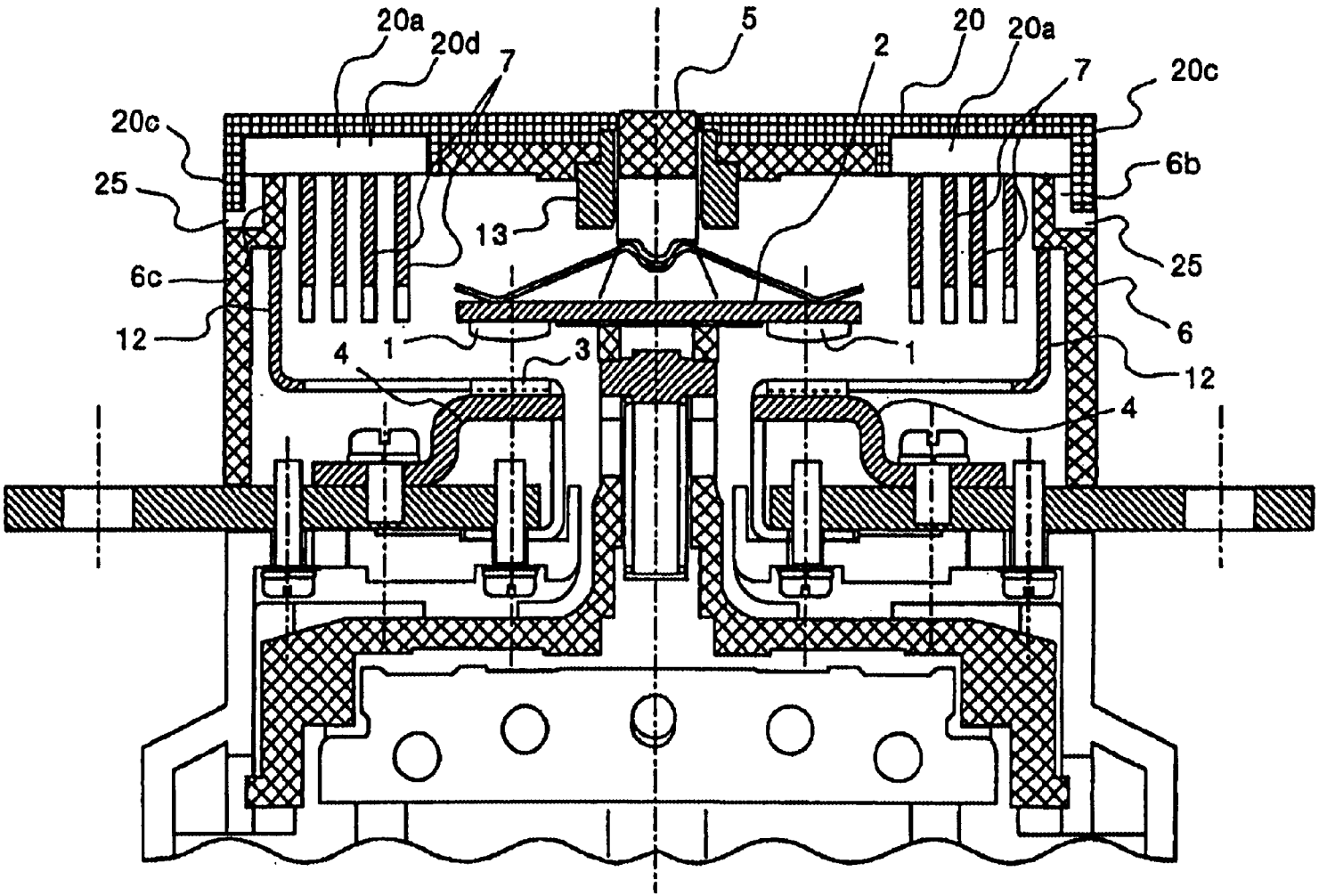
FIG. 9 is a sectional front view showing Embodiment 5 of an arc-extinguishing system for a contact switching apparatus.

FIG. 9 shows Embodiment 5 of the arc-extinguishing system for a contact switching apparatus according to the present invention. In this embodiment, an L-shaped bent groove 6*b* is formed above the arc box 6, and a side wall 20*c* for being inserted into the bent groove 6*b* is formed in the arc cover 20, so that a gas blow-off opening section 25 having an L-shaped path formed by the bent groove 6*b* and the side wall 20*c* is opened on the side face of the arc box 6.

In other words, a void 20*d* along the top end surface of the arc-extinguishing grid plates 7 is communicated and connected to a path substantially vertically formed (a path formed by the bent groove 6*b* and the side wall 20*c*) by the arc cover 20 and arc box 6 to form an L-shaped path, so that a gas blow-off opening section 25 having the L-shaped path is opened to the side face of the arc box 6.

In this arc-extinguishing system, the gas having passed through spaces between the arc-extinguishing grid plates 7 goes through a longitudinal space between the upper section of the arc-extinguishing grid plates 7 and the arc cover 20, and is led to the bent groove 6*b* along the side wall 20*c* where the gas turns round and is discharged from the gas blow-off opening section 25.

As a result, the gas stays inside the arc-extinguishing system for a longer time as compared to a case where the gas goes straight. The gas is sufficiently cooled down during the time, and is discharged from the gas blow-off opening section 25 to the outside.

Momentum of the gas is weakened due to pressure losses generated by turning several times during flowing until the gas is discharged from the gas blow-off opening section 25 to the outside. With this feature, the gas is not strong enough to be delivered to an external metallic body such as a control board where there may be ground fault, and a discharged position of the gas is lowered, so that, by being separated from the external metallic body provided above the contact switching apparatus, the gas does not flow through this section, so that ground fault due to the metallic body can be prevented.

Figure 10:
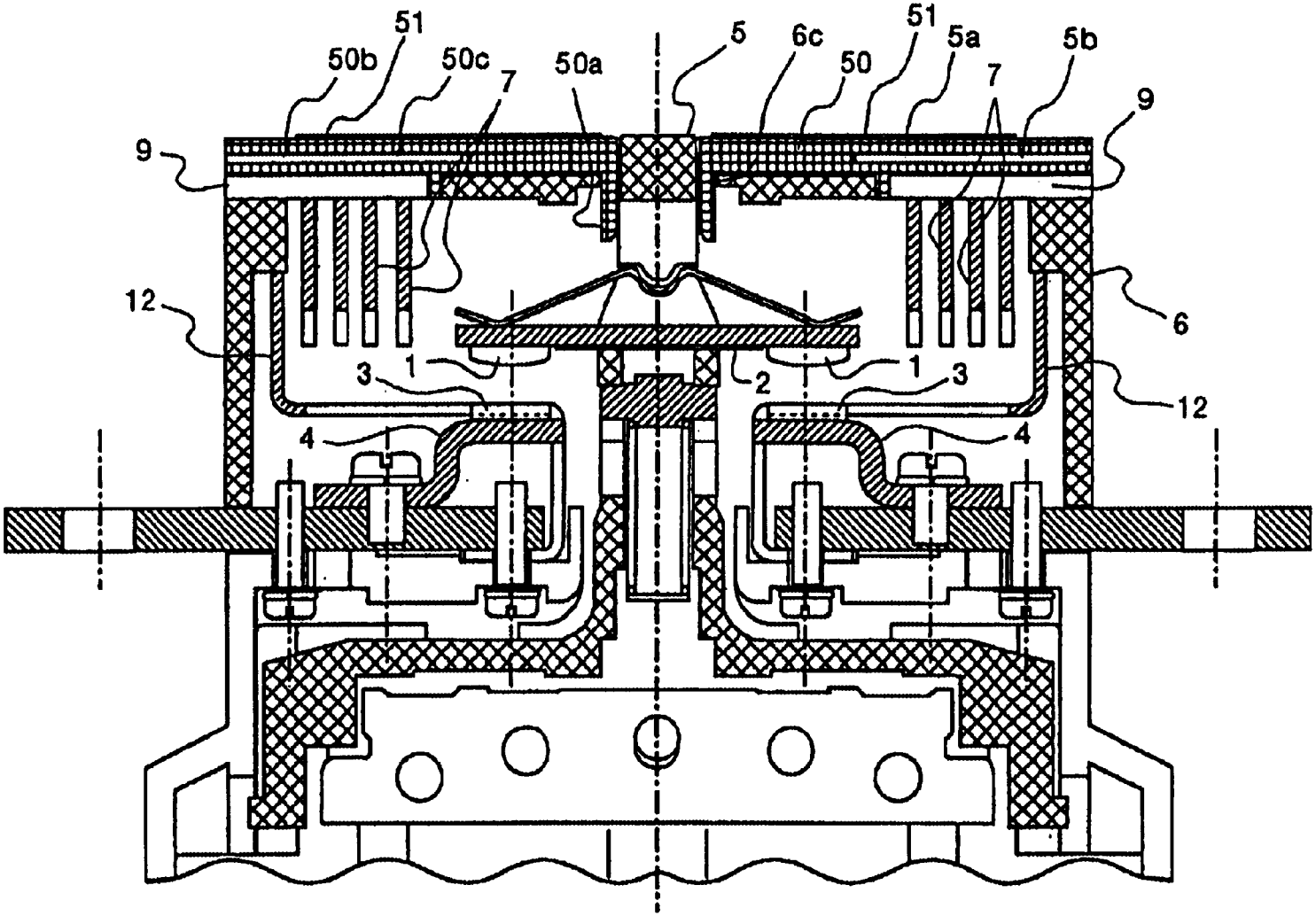
FIG. 10 is a sectional front view showing Embodiment 6 of an arc-extinguishing system for a contact switching apparatus.

FIG. 10 shows Embodiment 6 of the arc-extinguishing system for a contact switching apparatus according to the present invention. An arc cover 50 has a cylindrical guide section 50*a* constructed by a material having comparatively higher sliding capability for slidably supporting a cross bar 5 by being engaged in an engaged hole 6*c* opening on the top surface of the arc box 6, and a void 50*b* for heat insulation provided at a position corresponding to that above the section where arc-extinguishing grid plates 7 are arranged, and has a double cover structure according to the heatproof void 50*b*. It should be noted that the cylindrical guide section 50*a* is monolithically molded with the arc cover 50. A name plate 51 is adhered on the top surface 50*c* of the arc cover 50.

In this arc-extinguishing system, the arc box 6 and the cross bar 5 do not slide on direct contact with each other, but sliding is performed between the cylindrical guide section 50*a* of the arc cover 50 made of material having comparatively higher sliding capability and the cross bar 5. Assembly is realized only by engaging the cylindrical guide section 5 in the engaged hole 6*c*, so that there is no difference from the manner of covering the arc cover 50 on the arc box 6.

Also, in the arc-extinguishing system described above, the arc cover 50 heated by gas has a double cover structure with the void 50*b* for heat insulation, so that heat is hardly conveyed to the top surface 50*c* of the arc cover 50, so that there is no possibility that the top surface 50*c* of the arc cover 50 rises in high temperature. With this feature, a name plate 51 adhered on the top surface 50*c* of the arc cover 50 is not peeled off or printed color on the name plate 51 will never changed due to heat.

Figure 11:
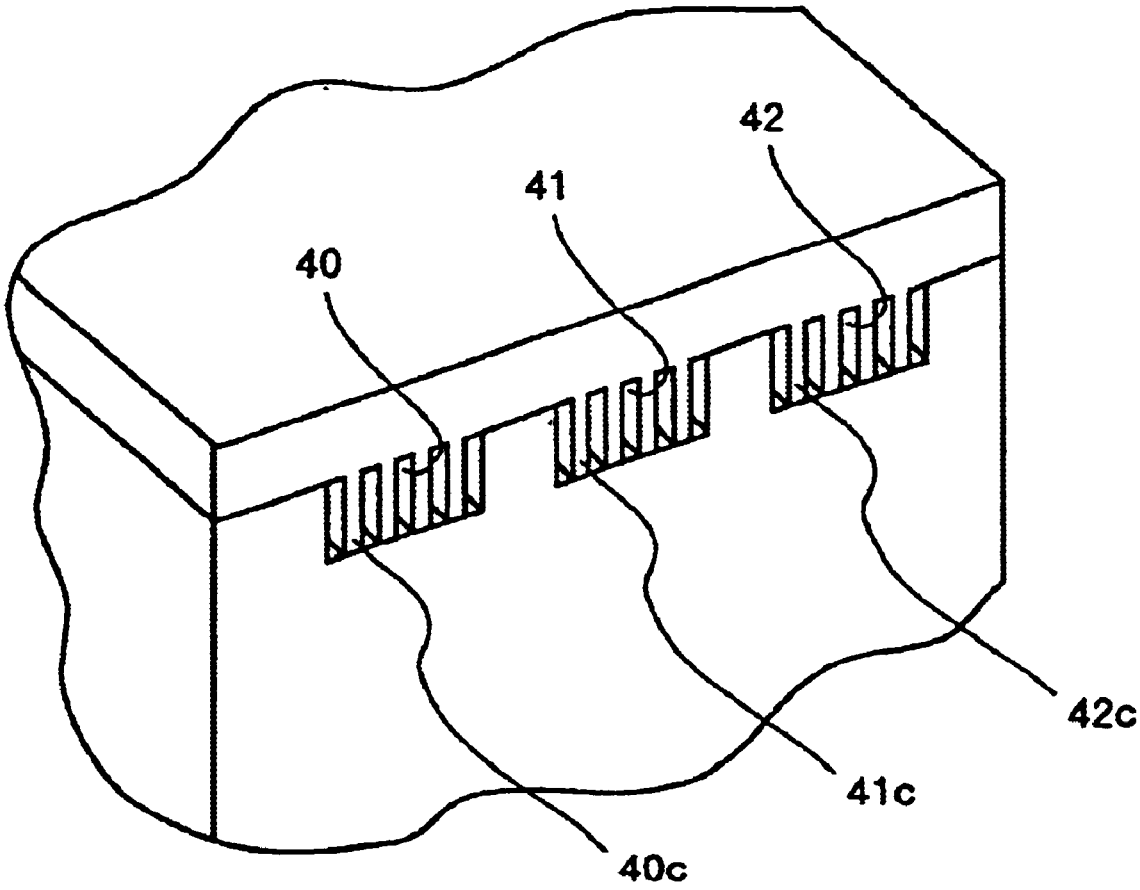
FIG. 11 is a perspective view showing a key section of Embodiment 7 of an arc-extinguishing system for a contact switching apparatus.
Figure 12:
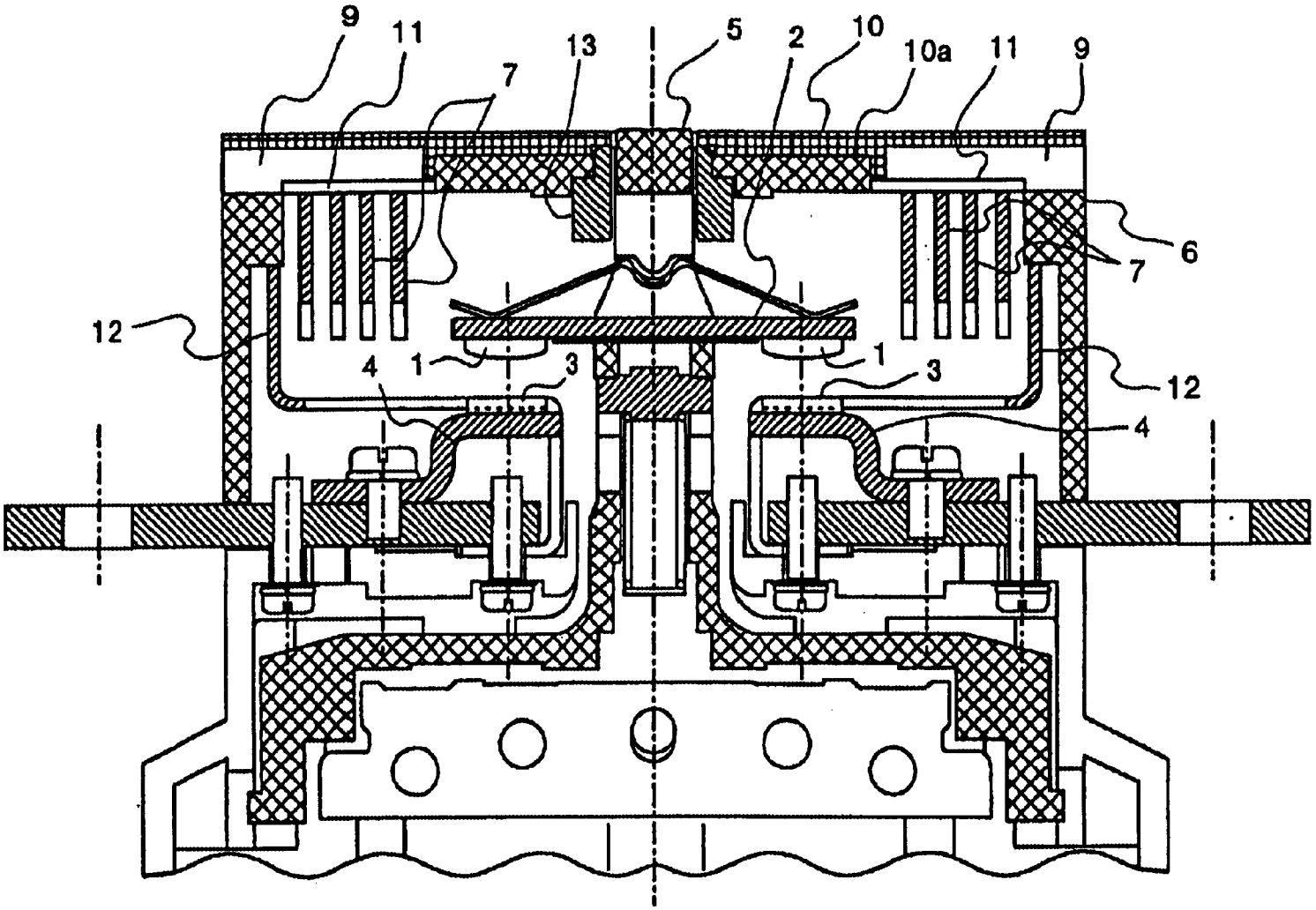
FIG.12 PRIOR ART
FIG. 12 is a sectional front view showing the conventional type of arc-extinguishing system for a contact switching apparatus.
Figure 13:
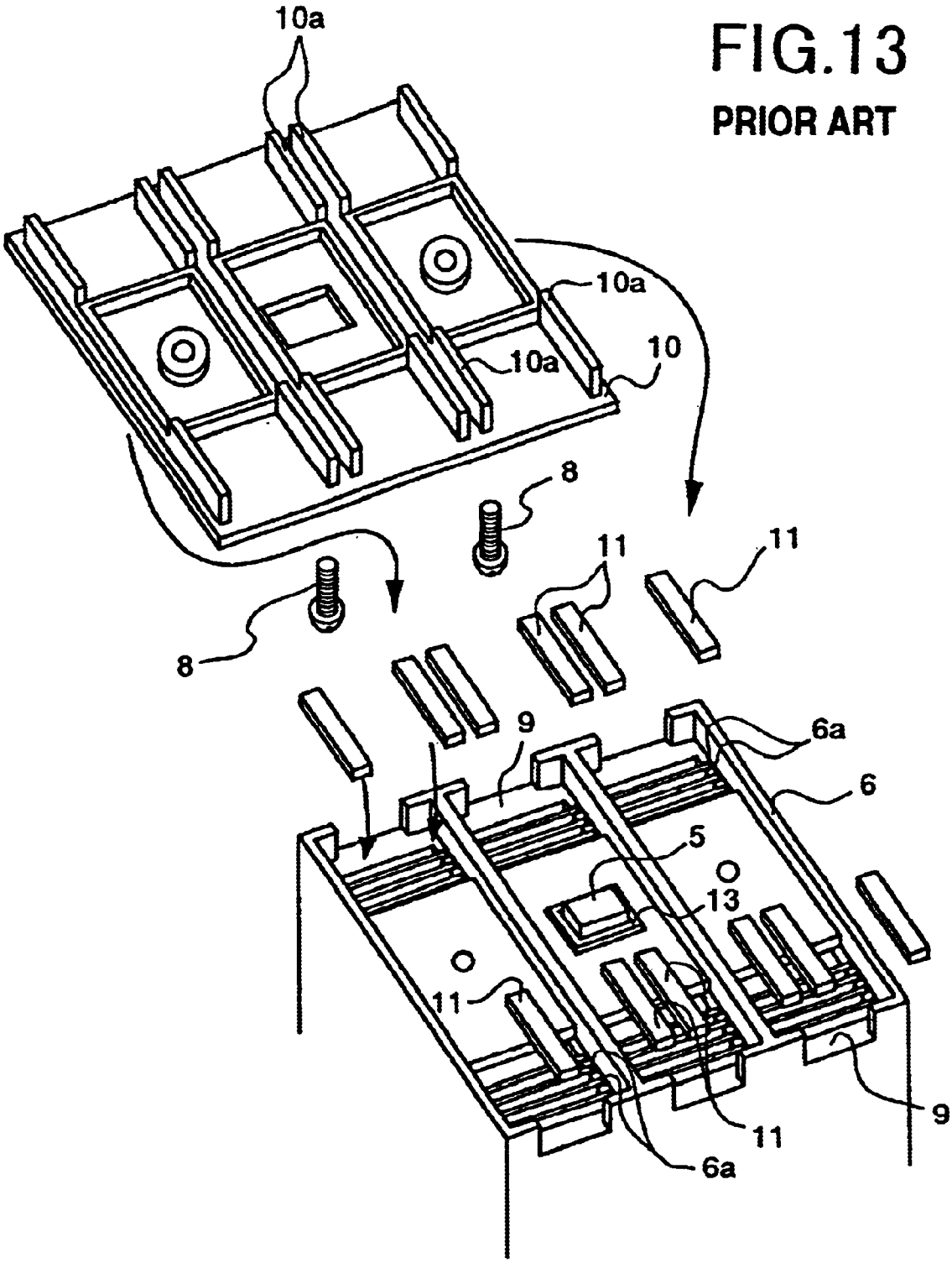
FIG.13 PRIOR ART
FIG. 13 is an exploded perspective view showing the conventional type of arc-extinguishing system for a contact switching apparatus.

FIG. 11 shows Embodiment 7 of the arc-extinguishing system for a contact switching apparatus according to the present invention. In this embodiment, there is provided a contact switching apparatus in which the pectinated projections 40*c*, 41*c*, 42*c* are provided in the upper surface of the gas blow-off opening sections 40, 41, 42 and subdivide these opening sections.

With this feature, instruction of foreign matters from the outside of the arc-extinguishing system can be prevented by the pectinated projections 40*c*, 41*c*, 42*c*.

This application is based on Japanese patent applications No. HEI 9-360179 and No. HEI 10-45493 filed in the Japanese Patent Office on Dec. 26, 1997 and Feb. 26, 1998, respectively, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An arc-extinguishing system for a contact switching apparatus comprising:

a plurality of arc-extinguishing grid plates, arranged outside a movable contact of the contact switching apparatus, vertical to said moveable contact, and an arc box and an arc cover, for covering said contact switching apparatus and said arc-extinguishing grid plates;

wherein a gas blow-off opening section, formed by said arc box and said arc cover, is opened at an angle with respect to a top of the arc cover or sides of the arc box, to direct a flow of gas discharged from the gas blow-off opening section.

2. An arc-extinguishing system for a contact switching apparatus according to claim 1; wherein a plurality of gas blow-off opening sections are provided on one side face of the arc-extinguishing system, and each of said gas blow-off opening sections is opened at an angle so that gas discharged from one of the gas blow-off opening sections and that discharged from the adjacent opening section are blown off in directions far off from each other.

3. An arc-extinguishing system for a contact switching apparatus according to claim 1; wherein a plurality of gas blow-off opening sections are provided on one side face of the arc-extinguishing system, and each of said gas blow-off opening sections is opened at an angle in a vertical direction, with respect to said side face, so that gas discharged from the adjacent opening sections are blown off in directions vertically, with respect to said side face, from each other.

4. An arc-extinguishing system for a contact switching apparatus comprising:

a plurality of arc-extinguishing grid plates, arranged outside a movable contact of the contact switching apparatus, vertical to said moveable contact, and an arc box and an arc cover, for covering said contact switching apparatus and said arc-extinguishing grid plates;

wherein a void along an end surface of the arc-extinguishing grid plates is communicated and connected to a path substantially vertically formed by the arc cover and the arc box to form an L-shaped path, so that a gas blow-off opening section having the L-shaped path is opened to a side face of the arc box.

5. An arc-extinguishing system for a contact switching apparatus comprising:

a plurality of arc-extinguishing grid plates, arranged outside a movable contact of the contact switching apparatus, vertical to said moveable contact, and an arc box and an arc cover, for covering said contact switching apparatus and said arc-extinguishing grid plates;

wherein a gas blow-off opening section, formed by said arc box and said arc cover, is covered by a plurality of subdividing projections provided from said arc cover.

* * * * *